United States Patent [19]

Smith et al.

[11] 3,939,085

[45] Feb. 17, 1976

[54] PROCESS FOR FORMING A LIQUID DEVELOPER ORGANISOL

[75] Inventors: Ian Edward Smith, Lockleys; Peter John Hastwell, Elizabeth Grove; Marinus Cornelus Vermeulen, Valley View, all of Australia

[73] Assignee: Savin Business Machines Corporation, Valhalla, N.Y.

[22] Filed: May 14, 1973

[21] Appl. No.: 359,650

Related U.S. Application Data

[62] Division of Ser. No. 155,108, June 21, 1971, Pat. No. 3,839,032.

[52] U.S. Cl. ..... 252/62.12

[51] Int. Cl.[2] ..... G03G 9/00

[58] Field of Search ..... 252/62.12

[56] References Cited

UNITED STATES PATENTS

| | | | |
|---|---|---|---|
| 3,576,744 | 4/1971 | Sharrock et al. | 252/62.12 |
| 3,640,751 | 2/1972 | Kasuya et al. | 252/62.12 |
| 3,640,863 | 2/1972 | Okuno et al. | 252/62.12 |
| 3,650,738 | 3/1972 | Ikeda et al. | 252/62.12 |
| 3,668,127 | 6/1972 | Machida et al. | 252/62.12 |
| 3,671,646 | 6/1972 | Kurita et al. | 252/62.12 |
| 3,772,053 | 11/1973 | Eastman et al. | 252/62.12 |
| 3,793,234 | 2/1974 | Ormsbee | 252/62.12 |

FOREIGN PATENTS OR APPLICATIONS

| | | | |
|---|---|---|---|
| 272,090 | 8/1962 | Australia | 252/62.12 |
| 272,838 | 5/1962 | Australia | 252/62.12 |
| 721,709 | 11/1965 | Canada | 252/62.12 |
| 743,492 | 9/1966 | Canada | 252/62.12 |

OTHER PUBLICATIONS

Condensed Chem. Dictionary, 6th Ed., Reinhold Publishing Corp., N.Y., N.Y., 1966, pp. 360, 378–380, 398.

*Primary Examiner*—Samuel Feinberg
*Assistant Examiner*—P. A. Nelson
*Attorney, Agent, or Firm*—Shenier & O'Connor

[57] ABSTRACT

Our invention contemplates a liquid developer which carries a toner which is tacky. This tackiness, however, is a transient one. After the latent electrostatic image is developed by our tacky toner, that is one that has adhesive properties, the developed image with the toner in tacky state is contacted with sheet material such as paper. The developed tacky toner image has greater affinity for the paper than it does for the photoconductive surface. We insure this by using a photoconductive surface which has less affinity for the tacky toner than the sheet material to which the image is to be transferred. After the image is transferred to the sheet material the toner quickly loses its tackiness and dries to a hard scuff-resistant surface.

Our invention also contemplates a developer liquid which contains a toner which is non-sticky when first deposited then becomes sticky or tacky so that it can be transferred while tacky and loses its tackiness and remains firmly bonded to the surface to which it is transferred. The developing liquid comprises a low-boiling organic liquid which has low solvent power for a sol comprising a high molecular-weight polymer and a finely divided pigment or toner material adapted to be attracted by the charges on the photoconductive surface. The organosol contains modifiers and plasticizers adapted to give the developer liquid the desired characteristics.

We have found that, if desired, the sheet material to which the tacky image is to be transferred can be treated to give it greater affinity for the tacky toner.

1 Claim, No Drawings

PROCESS FOR FORMING A LIQUID DEVELOPER ORGANISOL

This is a division of application Ser. No. 155,108, filed June 21, 1971, now U.S. Pat. No. 3,839,032.

BACKGROUND OF THE INVENTION

Electrostatic reproduction processes are well known to the art. In the well-known Xerox system a photoconductive surface carried by a drum is electrostatically charged by a corona discharge device. The photoconductive surface which may be of selenium or the like is an insulator in the dark and a conductor in the light. The image to be reproduced is focused on the photoconductive surface. When the light strikes the photoconductive surface the charge leaks away in the illuminated areas leaving the dark areas to form the image. The latent image in the form of electrostatic charges on the photoconductive surface is then developed by a toner. This toner must be in the form of a dry powder. The dry toner particles are then transferred by an electrostatic charge to sheet material such as ordinary paper and are usually formed from thermoplastic resins. The toner particles are then fixed by heat on the ordinary paper and the image appears in its final form. The necessity of using heat to fix the toner particles prevents high-speed operation of the Xerox system. Furthermore, the dry toners are slightly abrasive and sooner or later they scratch and mar the selenium surface of the drum which is the heart of the Xerox machine. The dry toner also causes mechanical problems since the toner particles become air-borne and permeate the bearings of the machine. This requires frequent cleaning, which is an onerous task. The dry toners have inherent dielectrophoretic properties which prevent their filling in large black areas. This is easily observed by viewing any copy which has a large, black area made on the Xerox machine.

In the Electrofax method, a sheet of paper is covered with a photoconductor such as zinc oxide. The latent electrostatic image can be developed either by a dry toner or by a liquid in which a toner is suspended. A liquid developer comprises finely divided pigment particles having an average size no larger than about twenty microns and probably much smaller to about an average size of about five microns, suspended in a relatively non-conductive light hydrocarbon such as benzene, zylene, hexane, naphtha, cyclohexane, or the like. The final image, of course, in the Electrofax process, appears on the photoconductor-coated surface and is not transferred to ordinary paper. It has been realized for some time by those skilled in the art that it would be desirable to use liquid developers in a transfer process. No one has found a way, however, to accomplish this conveniently. In U.S. Pat. No. 3,261,688 issued May 17, 1966, to Mihajlov, one attempt at the employment of liquid developers in a transfer process is shown. Mihajlov applies a film of liquid developer over the photoconductive surface. He then exposes the photoconductive surface and the developer simultaneously to a pattern of light and shadow. He then attempts to transfer the image to an ordinary paper. He has found, however, that the non-image areas have background toner. He attempts to reduce this by applying an electrical potential of the same polarity as that of the toner to the roll which presses the paper against the film of developer and makes the roller of conductive rubber or the like.

In all of the processes of the prior art in which transfer of an image is made from a photoconductor to ordinary paper, there is a loss of definition according to the application of pressure which distorts the developed image or through the difficulty of attaining effective transfer of development particles to a new location and the effective fixing of the same. Difficulty is also experienced when the same photoconductive surface is used repetitively, and images produced on it successively are transferred to another medium. The problem is that the photoconductive surface becomes soiled. This soiling is not very great when dry toners are used but in a method such as that of Mihajlov, the liquid toner will adhere to some extent to the photoconductive surface and gradually become unusable.

SUMMARY OF THE INVENTION

One object of our invention is to provide an improved liquid toner or developer which can readily be applied to a latent electrostatic image on a photoconductive surface from which it can readily be transferred to a second surface such as ordinary paper or the like.

A further object of our invention is to provide a novel liquid toner or developer which is non-sticky when first deposited, becomes sticky or tacky after deposit so it can be transferred while tacky and loses its tackiness and remains firmly bonded to the surface to which it is transferred.

Another object of our invention is to provide a toner which can be transferred while tacky to a dry surface and then cured to provide a scuff-free and abrasion-resistant final image.

Still another object of our invention is to provide a developer or toner which when tacky will have greater affinity for paper than the photoconductive surface on which the image was developed.

A further object of our invention is to provide a novel sheet material having affinity for a tacky toner developed image.

Other and further objects of our invention will appear in the following description.

In general, our invention contemplates the provision of a liquid toner having transient adhesive or tacky properties for developing a latent electrostatic image on a photoconductive surface and for enabling transfer of the developed image from the photoconductive surface to the surface of paper or the like. The toner composition has low adhesion for the image-forming surface and high-adhesion for the copy surface. The tacky or adhesive properties are transient and the final image exhibits high resolution and is scuff-free. While our invention contemplates the use of ordinary paper, other appropriate sheet material such as thin sheets of plastic, aluminum foil or the like may be used if desired. The copy paper may be coated with a thin film of synthetic resin for which the toner particles suspended in the developer liquid have affinity. This procedure will permit a wider variety of developer liquids to be used. This eliminates the criticality or close limits of components in the confection of the developer liquids.

The developer according to the present invention is so arranged that it is more adhesive in respect of the surface to which it is to be transferred than it is to the surface on which the latent image is produced. Accordingly, when the latent image is developed it can readily be transferred to the copy sheet because of its greater affinity for it.

In its simplest aspect we may give the photoconductive surface low adhesion by treating the same to provide a silicone or a urethane film. Similarly it is feasible to treat paper with a medium which will give the paper a physical affinity for the toner, that is, the developed toner image. In a similar manner it is possible to cool the photoconductive surface and heat the copy paper. This temperature differential will have the effect of enhancing the affinity of the developed image with a copy paper.

Ordinarily, it is more desirable to be able to employ untreated paper as the copy sheet to which the tacky toner image is to be transferred. However, it is also contemplated by our invention that a paper treated to have special affinity for the tacky toner can be employed. For example, we have treated the paper with a solution of an acid maleic-modified vinyl chloride and vinyl acetate copolymer. The solvent is evaporated and it will be found that the paper thus treated has a special affinity for the tacky tonered image.

Another example of a coating for paper is a solution of a vinyl-toluene butadiene copolymer resin. These resins are available from the Goodyear Tire and Rubber Company and sold under the trademark "PLIOLITE." They are soluble in aliphatic solvents and films are formed by simple evaporation of the solvents. A paper coated with PLIOLITE resin exhibits affinity for the tacky tonered image. Another example of a coated paper is one coated with a solution of polyvinyl butyral. This synthetic resin is dissolved in alcohol to form a 4% solution. It is then applied to the paper to form a thin continuous film. The affinity for the toner in each case of the paper coated with the examples given above was such that transfer took place from the photoconductive layer to the paper. It is of interest to note that the pressure to effect the transfer is very slight. As a matter of fact if too much pressure is used it was found that the transfer of the tonered image from the photoconductor to the paper was less effective.

It it not necessary that the developer deposit a toner in a tacky or sticky condition. The developer may be such that the tonered image is non-tacky at first then becomes tacky or adhesive so it can be transferred in a tacky state and then as the solvent evaporates, dries or cures and loses its stickiness and remains firmly bonded to the surface to which it was transferred.

According to our invention the adhesive toner comprises a relatively large amount of a high molecular weight polymer adapted to form a continuous pigmented polymer matrix exhibiting high cohesion and tackiness. In general, high molecular weight polymers are dissolved in a suitable solvent. The solution of the high molecular weight polymer is pigmented with a suitable pigment such as microlith black and the solution suspended in a low-power solvent or diluent with the aid of a dispersing agent. The high molecular weight polymer may be one which has a low adhesion for the image forming surface and a high affinity for the copy surface. Alternatively the high molecular weight polymer may have low adhesion for both surfaces and a tackifier is combined with the polymer to create the high adhesion for the copy paper. The main characteristic of the high molecular weight polymer, however, is that it is generally insoluable in the diluent which we employ in making our developer fluid. The diluent which we prefer is that manufactured by the Standard Oil Company of New Jersey and sold under the trademark "ISOPAR G". This is an isomerized paraffinic hydrocarbon having a specific gravity of 0.75 at 60°F. This product is substantially 100% pure isoparaffin. It has a boiling range from 157° to 177° C. ISOPAR H is a similar product and has a boiling range from 177° to 188° C. This is disadvantageous in that it takes a longer period of time for the copies to dry. The feature which characterizes the diluent is that it has low solubility for the solution of the high molecular weight polymer which is suspended throughout the diluent by a suitable dispersing agent. ISOPAR G has a kauri-butanol number of 27. This is true of ISOPAR E which has an initial boiling point of 116° C and a final boiling point of 143° C. ISOPAR E, however, is dangerous to use since it has a flash point of 50° F. The flash point of ISOPAR G is 105° F, and it is therefore a safer diluent. Because the tacky toner particles must migrate through the diluent under the influence of an electrostatic charge, the diluent must possess a low surface tension. ISOPAR is low in surface tension and high in interfacial tension. This accounts for its excellent demulsibility. Though other diluents which have low solvent power for the tacky toner organosol can be used, we prefer ISOPAR because of its manifold advantages in our process.

High molecular weight polymers which are used to form the solution to which the toner component is added are such that they are not soluble in the diluent. Appropriate high molecular weight resins which can be used are as follows:

| High Molecular Weight Resins | Manufacturer | Trademark |
|---|---|---|
| Vinyl-toluene/acrylate copolymer* | Goodyear Tire & Rubber Co., Akron, Ohio | "PLIOLITE VTAC" |
| Styrene/acrylate copolymer | Goodyear Tire & Rubber Co. | "PLIOLITE AC" |
| Styrene copolymer | Goodyear Tire | "PLIOLITE S-5A" |
| Butadiene-styrene copolymer** | Phillips Petroleum Co. | "SOLPRENE" |

*Solutions of this resin in solvents having kauributanol values of 36 and higher dry rapidly to form tough, hard film with good adhesion. Furthermore, a solution of this resin will not dissolve in "ISOPAR G" (which is one of our diluents) which has a kauributanol number of 27.

**"SOLPRENE 303" is a solution-polymerized copolymer in the ratio of 52/48 with partial block distribution of the styrene along the molecular chain. "SOLPRENE 1205" is a copolymer of butadiene and styrene in the ratio of 75/25 manufactured by the solution polymerization process.

These resins are readily soluble in hydrocarbon solvents having high kauri-butanol numbers of 50 or more. An appropriate solvent is the hydrocarbon solvent manufactured by Standard Oil Company of New Jersey and sold under the trademark "SOLVESSO 100". It has an inital boiling point of 159° C and a final boiling point or end point of 182° C. It consists largely of aromatic hydrocarbons and has a kauri-butanol number of 91. It is to be understood that any appropriate solvent may be employed. However, since some of the solvent for the resin will be present in the developer solution, its end point should be low.

As is pointed out above, ISOPAR G has an end point of 177° C. SOLVESSO 100 has an end point of 182° C. SOLVESSO 150 could be used, if desired, but it has an end point of 212° C. The particular solvent is not critical as long as it is a solvent for the high molecular weight resin and can be evaporated at convenient temperatures from the final developer solution.

While the high molecular weight resins we employ exhibit tackiness upon drying, that is, when they are almost dry, it is desirable to increase the tackiness. This is done by adding a resin which has tacky properties to the solution of the high molecular polymer. The resin which is added for tackiness, as is the case with high molecular weight resins, must be soluble in the solvent for the high molecular weight resin and substantially insoluble in the diluent which is being used for the developer liquid.

We have found that appropriate tackifier resins are as follows:

| Tackifier Resins | Manufacturer | Trademark |
|---|---|---|
| Polymerized alpha pinene | Pennsylvania Industrial Chemical Corp. | "PICCOLYTE ALPHA" |
| Polymerized beta pinene | Pennsylvania Industrial Chemical Corp. | "PICCOLYTE BETA" |
| Polymerized mixed olefins* | Reichhold Chemicals, Inc. | "STA-TAC" |
| Heat-reactive synthetic hydrocarbon polymers** | Reichhold Chemicals, Inc. | "BETAPRENE BC" |
| Pentaerythritol ester of hydrogenated rosin | Hercules Inc. | "PENTALYN H" |

*These provide performance qualities comparable to those achieved by pure terpene resins.
**These polymers have iodine numbers of about 130, but the double bonds are structurally protected and not easily cross-linked or oxidized. They behave much like terpene resins and provide good wetting properties and adhesion to a wide variety of surfaces.

The high molecular weight resins may be plasticized to render them tacky by modifying agents. These are:

| Plasticizers for High Molecular Weight Resins | Manufacturer | Trademark |
|---|---|---|
| Dibutyl phthalate | Celanese Corp. of America | |
| Dioctyl phthalate | Celanese Corp. of America | |
| Dimethyl phthalate | | |
| Diethyl phthalate | | |
| Di-isobutyl phthalate | | |
| Di-iso-octyl phthalate | | |
| Chlorinated polyphenyl | Monsanto Chemical Company | "AROCLOR 1254" |
| Tricresyl phosphate | Union Carbide Plastics Co. | |

Some of the high molecular weight resins, such as "PLIOLITE VTAC", do not possess sufficient tackiness to effect complete transfer. We have seen that a tackifier resin may be added compatible with the high molecular weight resin to give the organosol the desired tackiness. This tackiness can be achieved by adding plasticizers to the high molecular weight resin. These plasticizers have the property of imparting tackiness to the high molecular weight resin so that less or no tackifier resin may be employed.

In carrying out our invention, we first manufacture the organosol by dissolving a high molecular weight resin or a mixture of high molecular weight resins in an appropriate solvent.

EXAMPLE A

The following formulation is prepared:

37.5 gms. PLIOLITE VTAC
40.0 gms. SOLPRENE 1205
100.0 gms. SOLVESSO 100

As we have pointed out above, SOLVESSO 100 is an ideal solvent. Any other appropriate solvent such as terpineol can be employed. The above formulation is emulsified in a high-speed emulsifying mill, together with 1,100 mls. of a diluent such as ISOPAR G. A quantity of this organosol is further diluted with ISOPAR G to any desired extent to form a suspension. This suspension produces a tacky resin deposit on a negative polarity electrostatic surface charge.

The toner component is formulated to be compatible with the resin organosol, since it must be physically attached to the resin developer aggregates or co-deposit at a rate in substantially the same proportion as the ratio of toner component to the organosol solids. If the toner component is not compatible with the organosol solution, it will act as a separate system and deposit at a greater rate than the organosol. This will pull the pigment out of the developer liquid, and the deposit will be predominantly pigment. This will result in low cohesion and poor transfer qualities.

The toner should have the same resin system as the organosol. In the example we are considering, the two resins used were PLIOLITE VTAC and SOLPRENE 1,205. The pigment may be of any desired nature as, for example, carbon black, having a particle size on the average of 25 millimicrons. Any desired pigment may be used as, for example, reflex blue pigment with the carbon black. The pigment is advantageously coated with a modifying resin or a drying oil. A toner matching the organosol of this Example A is as follows:

100.0 gms. microlith black
12.5 gms. reflex blue
25.0 gms. PLIOLITE VTAC
25.0 gms. SOLPRENE 1,205

Sufficient toluol was added to the above mixture to achieve the correct milling viscosity for milling in a triple-roll mill. After milling, the mixture was diluted with 600 mls. of ISOPAR G. This toner is effective for negatively charged electrophotographic images.

The resin organosol and the toner component are mixed in a high-speed emulsifying mill and the constituents milled together. The resin solution prepared as described above was diluted with 1,100 mls. of ISOPAR G and milled for one minute. Then 120 mls. of the toner component were added and the mixture milled for three additional minutes. This concentrated adhesive toner was further diluted in a ratio of 50 mls. of toner to 200 mls. of ISOPAR G to produce a developer liquid. Adhesive or tacky toner in this developer liquid is readily deposited on a negative polarity surface charge. It will be understood that there is nothing critical in the method of mixing the components. The toner components may first be added to the mill with 1100 mls. of ISOPAR G and then followed by mixing with the resin solution. Alternatively, the resin and the toner may be combined and then added to the mill with the diluent.

This adhesive toner developing liquid produced good image transfer between an organic photoconductor and an uncoated paper such as Velvet Book Opaque. It also produced good transfer between a zinc oxide resin photoconductor and a Velvet Book Opaque paper. A low density image was observed on the zinc oxide photoconductor after transfer. The photoconductive surface was a commercial zinc oxide photoconductor and not one of our special non-adhesive formulations as described above.

We then formulated another organosol component as follows:

EXAMPLE B 37.5 gms. PLIOLITE VTAC
20.0 gms. BETAPRENE BC 100 which is a tackifier resin
100.0 gms. SOLVESSO 100

The addition of the tackifier to the resin component and its incorporation into the developing fluid in the manner identical to that described above produced a developing fluid in which the image transfer from the organic photoconductor to the Velvet Book paper was less complete. On the other hand, when this toner was used with art paper, the transfer was more complete. It is to be understood, of course, that the photoconductors tested were not of the type of our invention having a low adhesion. When these toners were tested with photoconductors of our invention, the transfer of our tacky toner from the photoconductive surface to the paper was substantially complete.

The amount of toner component combined with the organosol component changes the adhesive properties. With 120 mls. of toner component, optimum adhesive transfer properties were achieved. The toner component in the amount of 60 mls. produced a deposit of low optical density and there was greater sedimentation of the toner concentrate. A toner component of 240 mls. produced an optically dense deposit. The cohesion and adhesion were lowered with a resultant loss of transfer properties.

EXAMPLE C

An organosol was formed as follows:

37.5 gms. SOLPRENE 303
20.0 gms. PICCOLYTE ALPHA
10.0 gms. Polystyrene (melting point 75° C; approximate molecular weight 400)
100.0 gms. SOLVESSO 100

This resin mixture s milled in a high-speed emulsifying mill together with 1,100 mls. of a diluent such as ISOPAR G. This forms the resin solution or organosol.

The toner component matching the Example C organosol was made as follows:

200 gms. microlith black
25 gms. reflex blue
50 gms. PLIOLITE S-5D
75 gms SOLPRENE 1205

These were placed in a triple-roll mill and sufficient toluol was added to dissolve the mix and produce good milling viscosity. The mix was then diluted with 1,200 mls. of ISOPAR G in a high-speed emulsifying mill. The resin mix was added to 1,200 mls. of ISOPAR G in a high-speed emulsifying mill, to which was then added 120 mls. of the toner component Type C. This produced a developing liquid of our invention which exhibited low adhesion for both the organic and zinc oxide photoconductors and high adhesion for bond paper, Velvet Book paper, and art paper.

It will be observed that in each case the toner component is compatible with the organosol, so that the high molecular weight polymer nucleates or attaches to the toner component. In order to achieve this, the pigment must be wetted with a material which allows compatibility with the high molecular weight polymer. After the toner component is milled, it is tested for its electrophoretic properties. The tests varied depending on the type of pigment employed. Some tests showed that toner components deposit both on negatively and positively charged electrostatic surfaces. A toner component of this nature may still be useful, if it is combined with the organosol, since in this case the toner charge control is supplied by the high molecular weight resin.

An example of this follows:

EXAMPLE D

An organosol was confected as before from the following:

37.5 gms. PLIOLITE VTAC
20.0 gms. BETRAPRENE BC-100
100.0 gms. SOLVESSO 100

The matching toner component was made as follows:

50 gms. carbon black (particle size 25 millimicrons)
50 gms. BETAPRENE BC-100
25 gms. SOLVESSO 100

We stirred this mixture in a Cowles dissolver and then milled the mixture in a triple-roll mill. The mixture was then diluted with ISOPAR G and the toner produced an immediate deposit on both positive and negative polarity electrosurface charges.

Twenty-five grams of the toner component was added to the organosol solution and stirred with a Cowles dissolver. The solution was then added to 1,100 mls. of ISOPAR G in a high-speed emulsifying mill and milled for three minutes.

The resultant adhesive toner concentrate was diluted in the ratio of 50 mls. concentrate to 200 mls. of ISOPAR G to produce an adhesive developing liquid. This adhesive developing liquid produced a deposit on negatively charged zinc oxide photoconductor which was then transferred completely to uncoated bond paper. This formulation is characterized by a high-yield electrophoretic deposition on a negative polarity charged surface. The pigment to resin ratio of this toner is approximately 1:6.

It will be seen that a high molecular weight polymer may form a solution which may be then suspended in a diluent having low solvent power. PLIOLITE VTAC acting by itself exhibits good adhesion to most surfaces. We can modify the adhesive properties by using other high molecular weight polymers which in themselves have a lower adhesion for most surfaces. Adhesion can be increased by adding tackifier resins which impart additional adhesion to high molecular weight polymers. Plasticizers may be added to modify the adhesive properties, if such be desired.

The pigment component acts to reduce sedimentation of the toner concentrate. Our tacky toners generally comprise relatively large aggregates and consequently suffer greater sedimentation than liquid toners of the prior art. This, however, does not present practical problems as long as the sediment is flocculent, since such flocculent sediment is easily redispersed by mechanical agitation. It is for this reason that we have shown an agitator in our developer tank.

It will be observed that, in general, we employ a high molecular weight polymer which has a low adhesion for the image-forming surface and a high adhesion for the copy surface. We add another high molecular weight polymer which acts as a dispersing agent to produce optimum resin deposit and the required electrostatic charge polarity. These resins in solution form an organosol. If the high molecular weight polymer does not have sufficiently high adhesion, we may add a tackifier or a plasticizer which creates a high adhesion for the copy paper. The resins and plasticizers which are chosen must be insoluble in the diluent which suspends the organosol and the toner formulation.

It will be seen that we have accomplished the objects of our invention. Our transfer method of a developed electrostatically formed image utilizes the tackiness of the toner and does not depend on an electrostatic field. We have provided a method of contact transfer of a liquid toner developed electrostatic image from a photoconductive surface to a copy sheet while maintaining the conductive surface in a clean condition. We have provided a liquid developer which has greater affinity for the copy paper than the photoconductive surface on which the image was formed. We have provided a novel developing liquid carrying in suspension a toner which is non-sticky when first deposited, which becomes sticky or tacky after deposit, so that it can be transferred in its tacky condition, and which then loses its tackiness so that it remains firmly bonded to the surface to which it is transferred. We have provided a novel sheet material having a special affinity for a tacky toner developed image.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A method of compounding a developing liquid for developing latent electrostatic images including the steps of forming an organosol comprising a solution of high molecular weight resin in a solvent having a kauri-butanol number in excess of 50, suspending said solution in a diluent having a kauri-butanol number of less than 30, forming a solution of a high molecular weight resin in a solvent having a kauri-butanol number greater than 50, milling said solution with a finely divided pigment having electrophoretic properties, suspending said pigment mix in a diluent having a kauri-butanol number of less than 30 and then mixing the high molecular weight resin suspension and the pigment suspension to form a developing liquid in which the pigment to resin ratios are between 1:11 and 1:1.

* * * * *